US005622360A

United States Patent [19]

Rathert et al.

[11] Patent Number: 5,622,360

[45] Date of Patent: Apr. 22, 1997

[54] FEEDER STATION FOR COLLATING APPARATUS

[75] Inventors: Horst Rathert, Minden; Joachim Schroder, Mellinghausen, both of Germany

[73] Assignee: Kolbus GmbH & Co. KG, Rahden, Germany

[21] Appl. No.: 341,769

[22] Filed: Nov. 18, 1994

[30] Foreign Application Priority Data

Nov. 18, 1993 [DE] Germany ..... 43 39 300.4
Oct. 19, 1994 [DE] Germany ..... 44 37 327.9

[51] Int. Cl.[6] ..... B65H 5/22; B65H 39/02

[52] U.S. Cl. ..... 271/3.2; 271/4.1; 271/10.11; 271/225; 271/184; 271/84; 270/58.29

[58] Field of Search ..... 271/3.14, 3.18, 271/3.2, 3.24, 4.1, 9.01, 184–187, 198, 225, 84, 269, 273–275, 306, 307, 314, 315, 213–214, 10.11–10.13; 270/52.16, 52.21, 52.22, 58.29

[56] References Cited

U.S. PATENT DOCUMENTS 3,414,257 12/1968 Muller .
3,976,290 8/1976 Wallace ..... 271/225 X
4,401,299 8/1983 Muller ..... 270/58.29
4,607,835 8/1986 Wilson et al. ..... 271/274 X
4,875,670 10/1989 Petersen et al. ..... 271/273 X
5,375,834 12/1994 Rathert ..... 271/184 X

FOREIGN PATENT DOCUMENTS 1486744 8/1970 Germany .
2937611A1 9/1979 Germany .
3126808 4/1982 Germany .
3935372 10/1989 Germany .

*Primary Examiner*—Boris Milef
*Attorney, Agent, or Firm*—Chilton, Alix & Van Kirk

[57] ABSTRACT

A feeder station for apparatus for collating printed sheets includes a mechanism for imparting motion to individual sheets prior to the time the sheets are engaged by a pusher mechanism which propels the stack of collated sheets being formed along a conveyor. The mechanism for imparting motion to the individual sheets in the feeder station contacts the sheets within a region which is directly aligned with the path the engaged portion of the sheet travels in moving from a feed magazine to the feeder station under the influence of a gripper device, the sheet thus being transferred directly from the gripper device into contact with the motion imparting mechanism.

20 Claims, 4 Drawing Sheets

FEEDER STATION FOR COLLATING APPARATUS

BACKGROUND OF THE INVENTION

1. Field of the Invention

The present invention relates to the collation of printed sheets and, particularly, to the feeding of individual sheets of paper in the proper order onto a stack of sheets being formed on a conveyor. More specifically, this invention is directed to a feeder station for a machine in which printed sheets are gathered into ordered stacks and, especially, to a feeder station wherein individual sheets caused to move in a first direction upon withdrawal from a supply are subsequently accelerated in a second direction and are thereby caused to be moving when acquired by a pusher mechanism which moves the stack being formed along the path defined by a conveyor. Accordingly, the general objects of the present invention are to provide novel and improved method and apparatus of such character.

2. Description of the Prior Art

While not limited thereto in its utility, the present invention is particularly well suited for use in the manufacture of books. In the assembly of the pages of a book preparatory to binding, it is necessary that the printed sheets comprising the individual pages be processed rapidly while being handled gently. In order to perform this gathering or collating function, apparatus having plural feeder stations which are serially arranged along a path defined by a conveyor are known in the art. In such prior art apparatus, the feeder stations will each have a supporting table to which individual printed sheets, separated from a supply stack, are delivered. These individual sheets are subsequently accelerated from a rest position on the supporting table to the transport speed of the conveyor by means of a pusher element which moves with the conveyor. In the case of high throughput speed, and/or in the case of lightweight sheets, the impact of the pusher element on the edge of the sheet at the beginning of the acceleration cycle may result in the sheet becoming bent or buckled. Any such bending or buckling has the potential of causing malfunction of the collating machine.

In an effort to overcome the above-briefly described problem with prior art collating apparatus, attempts have been made to "pre-accelerate" sheets deposited on feeder station support tables. Restated, it has been proposed to impart motion, in a path generally parallel to that of the gathering conveyor, to a sheet on a feeder station support table prior to its being acquired by a pusher element. An example of such a pre-acceleration arrangement is shown in published German patent DAS 14 86 744. In the arrangement of this German application, a reciprocating motion in the conveying direction is imparted to the supporting tables of the feeder stations of a collating machine. In theory, and providing that sychronization is maintained, the pusher elements will contact a sheet while it is moving with its support table in the downstream direction and thus the pusher element needs only to further accelerate the sheet from the forward speed of the support table to the transport speed of the conveyor. An arrangement of the type shown in German Patent DAS 14 86 744 has the inherent disadvantages that rather expensive apparatus is required and an upper limit on production rate is imposed by the need to impart reciprocating motion to machine elements which necessarily have a mass.

Another approach to providing pre-acceleration to printed sheets may be seen from published German application DAS 29 37 611. A rotating accelerating element is employed in the method and apparatus of this approach. The rotating accelerating element acts against the stationary support table of the feeder station and, upon acquiring a printed sheet resting on the support table, accelerates the sheet in the conveying direction as a consequence of frictional adhesion between the sheet and rotary accelerating element. The reliance upon frictional adhesion suffers from the inherent disadvantages that it may cause twisting of the sheet to be accelerated and often produces marks on the sheet resulting from the pinching thereof between the accelerating element and the stationary support table.

In the case of sheets having a wide format, in order to avoid twisting at the time of acquisition of the sheet by a pusher element of the conveyor, it has been suggested that the rotating accelerating element be given a rod-like configuration and be positioned parallel with the supporting table. Such an arrangement may be seen from published German application DOS 31 26 808.

The previously proposed collating apparatus, wherein a rotary accelerating element was associated with each feeder station support table, require relatively complicated constructions which are volumetrically inefficient. Thus, the space requirements for such constructions preclude their universal use on all prior art collating systems. Also, the initial set-up of such apparatus is very time-consuming, as is their readjustment to each different printed-sheet thickness to be handled. Finally, no means have yet been provided to exclude the possibility of marring of the printed sheets by accelerating roller marks.

SUMMARY OF THE INVENTION

The present invention overcomes the above-discussed and other deficiencies and disadvantages of the prior art and, in so doing, provides a novel technique for pre-accelerating, generally in a conveying direction, individual printed sheets which have been deposited on a support table of a feeder station, the pre-acceleration occurring prior to the acquisition of the sheet by a pusher element associated with the conveyor. Apparatus for implementing this novel technique is characterized by a high degree of functional reliability even when processing printed sheets falling within the broadside or landscape format range.

Apparatus in accordance with the invention may desirably be employed in collating apparatus which includes a series of feeder stations. Such collating apparatus has a conveyor with moving pusher elements. The conveyor defines a transport channel which extends through the feeder stations and the pusher elements of the conveyor cooperate with the transport channel to define a transport direction and path. Each feeder station has a receiving table and gripper means for pulling individual sheets from a stack of sheets in a feed magazine and depositing the thus extracted sheets on the receiving table. The feeder stations are constructed such that the sheets deposited on the feeder station receiving tables will be contacted by a pusher element of the conveyor and will be swept thereby from the receiving table into the conveyor defined channel and subsequently moved along the channel in the transport direction. The gripper means may, for example, be in the form of a rotating pull-off drum which supports controllable gripper elements. The gripper elements define a sheet engagement and transfer zone having a predetermined length in a direction which is generally parallel to the transport direction of the conveyor. This transfer zone, lying between the end faces of the pull-off drum, extends from a feed magazine through the receiving table. The rotating gripper elements engage a printed sheet, withdraw the engaged sheet from the feed magazine and move the sheet in a direction which is generally transverse to the transport direction. Upon reaching the receiving table the sheet is released by the gripper elements.

In accordance with the invention, the means for pre-accelerating sheets which have been deposited on a feeder station receiving table include rotatable accelerating means positioned to contact the upper side of a sheet on the receiving table within the transfer zone. This positioning results in the extracted sheet being transferred directly from the gripper means into contact with the accelerating means. Additionally, apparatus in accordance with the invention employs roller means which extend through the receiving table from the underside to cooperate with the accelerating means, the sheet being pre-accelerated thus being contacted on opposite sides by cooperating rotatable means. The sheets being pre-accelerated are thus not pinched between an accelerating roller and the immobile surface of a support table.

In apparatus in accordance with the present invention, as a result of locating the components which impart the desired pre-accelerating movement in the plane or zone in which the gripping elements associated with the pull-off drum move, the accelerating means takes over the printed sheet directly from the gripper means and holds the sheet in position on the receiving table. Accordingly, uncontrolled movements of the printed sheets are eliminated thereby significantly enhancing functional reliability. Further, the arrangement of the accelerating elements in accordance with the present invention permits the processing of sheets having an extremely small format.

Also in accordance with the invention, and as a result of the positioning in the receiving table of a supporting roller with which the accelerating element is brought into functional association, frictional forces applied to the sheets during the pre-acceleration are very greatly reduced and thus the danger of tearing or crumpling of the printed sheets is virtually eliminated. In accordance with a preferred embodiment, wherein the accelerating element is in the form of a pair of spaced segments, tearing of the sheets is prevented even when processing printed sheets which fall within the broadside or landscape-format range.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSURE EMBODIMENTS

Figure 1:
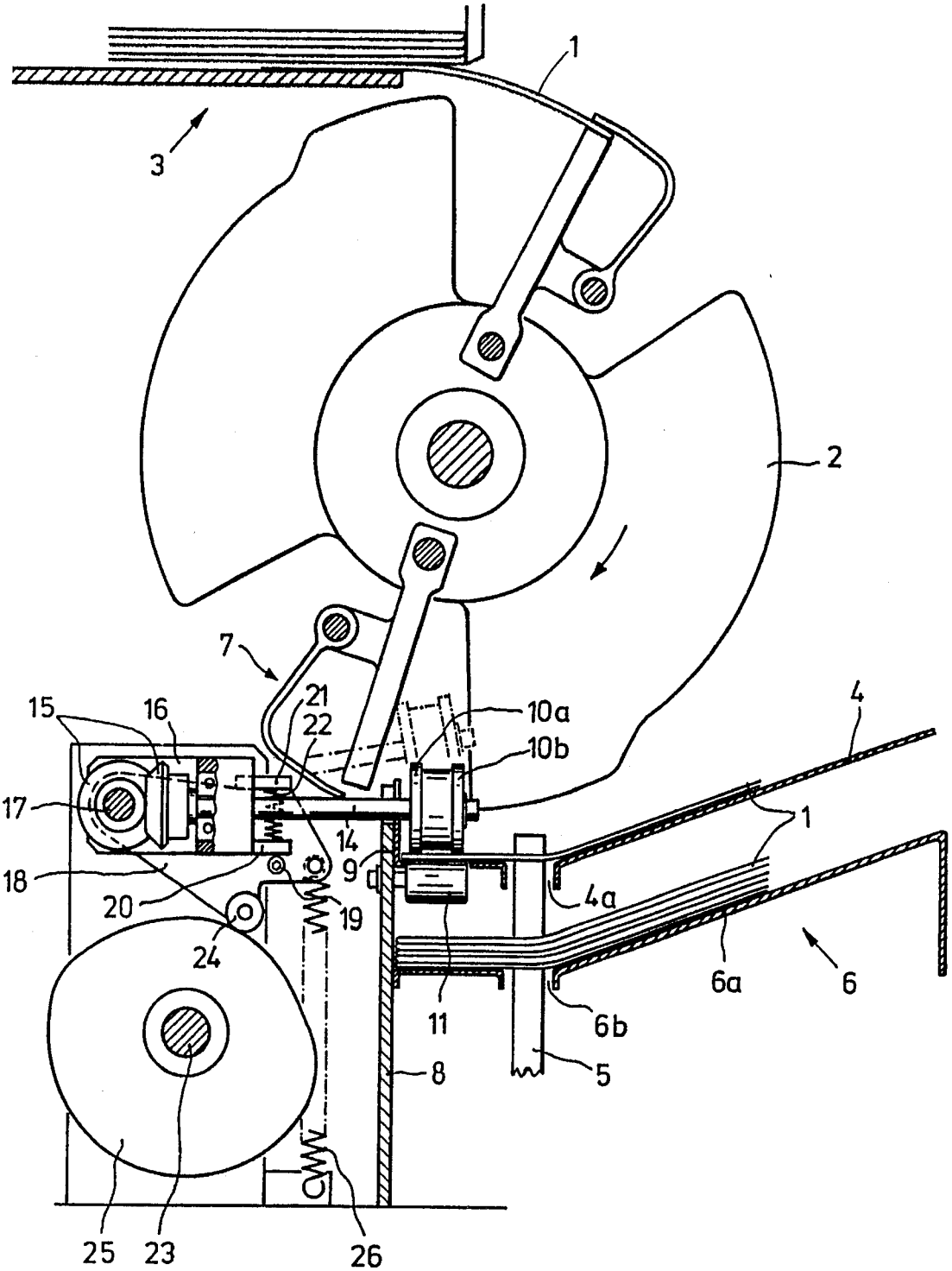
FIG. 1 is a schematic, side-elevation view, partly in section, of a feeder station employing apparatus in accordance with the present invention, the view of FIG. 1 being taken along line 1—1 of FIG. 2*a;*

A single feeder station for a gathering machine is depicted in the drawings. Considering FIGS. 1 and 2, the disclosed feeder station, and other identical feeder stations, will be located along a gathering conveyor indicated generally at 6. Each feeder station includes means for withdrawing printed sheets 1 from a feed magazine, indicated generally at 3, and delivering the thus withdrawn sheets onto a receiving table 4. The withdrawing means, in the disclosed embodiments, comprises a pull-off drum 2 having a controllable gripper mechanism indicated generally at 7. The gripper mechanism 7 operates in the region between the end plates 2*a* and 2*b* of drum 2. Drum 2, and accordingly also the gripper mechanism 7, rotates about an axis which is oriented generally parallel to the direction of movement of printed sheets 1 along the gathering conveyor 6. The sheets 1 being extracted from magazine 3 are thus gripped in a region disposed between parallel planes defined by the end plates 2*a* and 2*b* of the rotating pull-off drum 2. This engagement region moves generally transversely with respect to the conveying direction, i.e., the engagement region defines a transfer zone, as the sheets are moved from the feed magazine 3 to the receiving table 4.

Figure 2A:
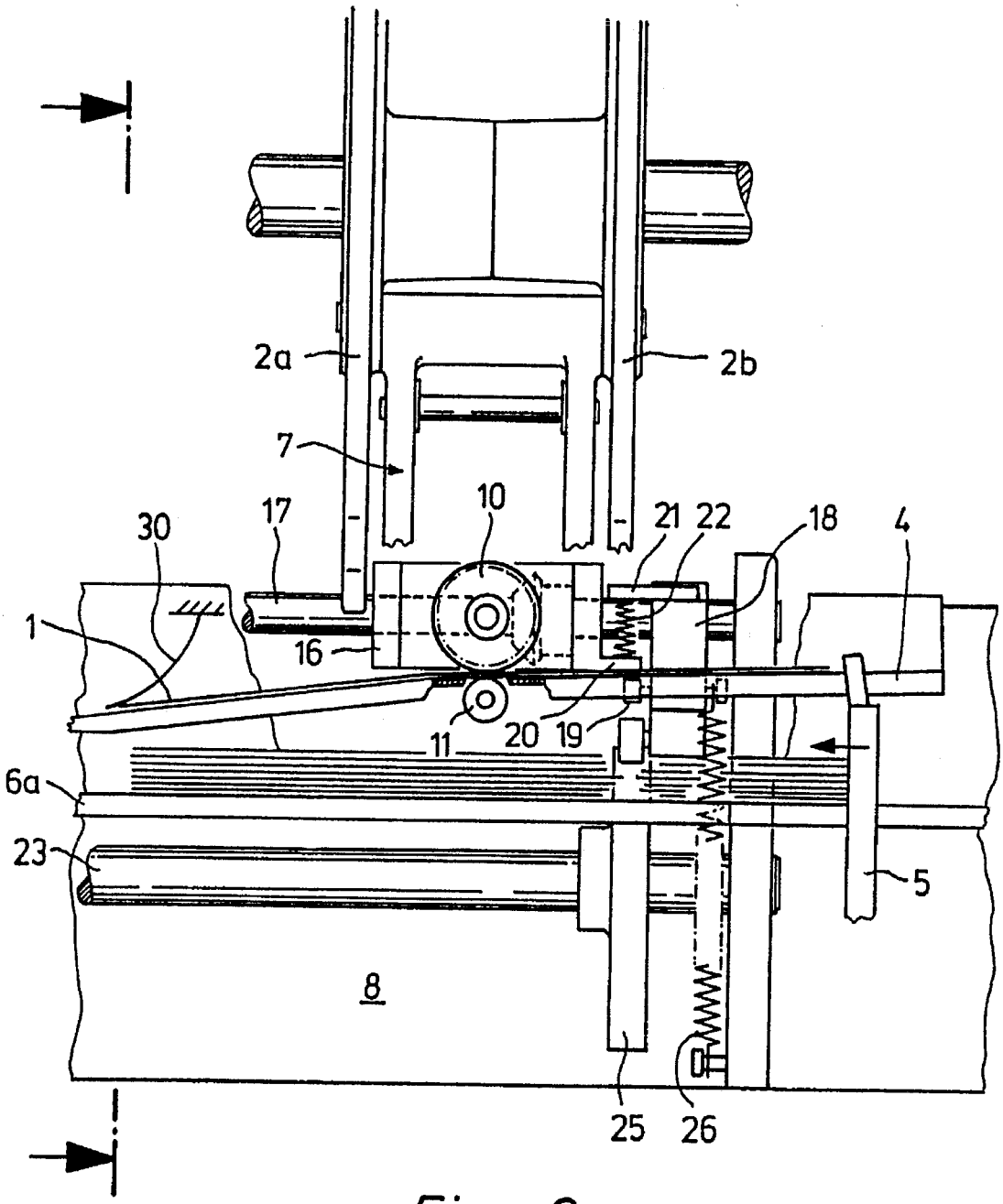
FIG. 2*a* is a side-elevation view, taken in a direction transverse to the view of FIG. 1, showing the apparatus prior to acquisition of a sheet to be pre-accelerated by the conveyor.
Figure 2B:
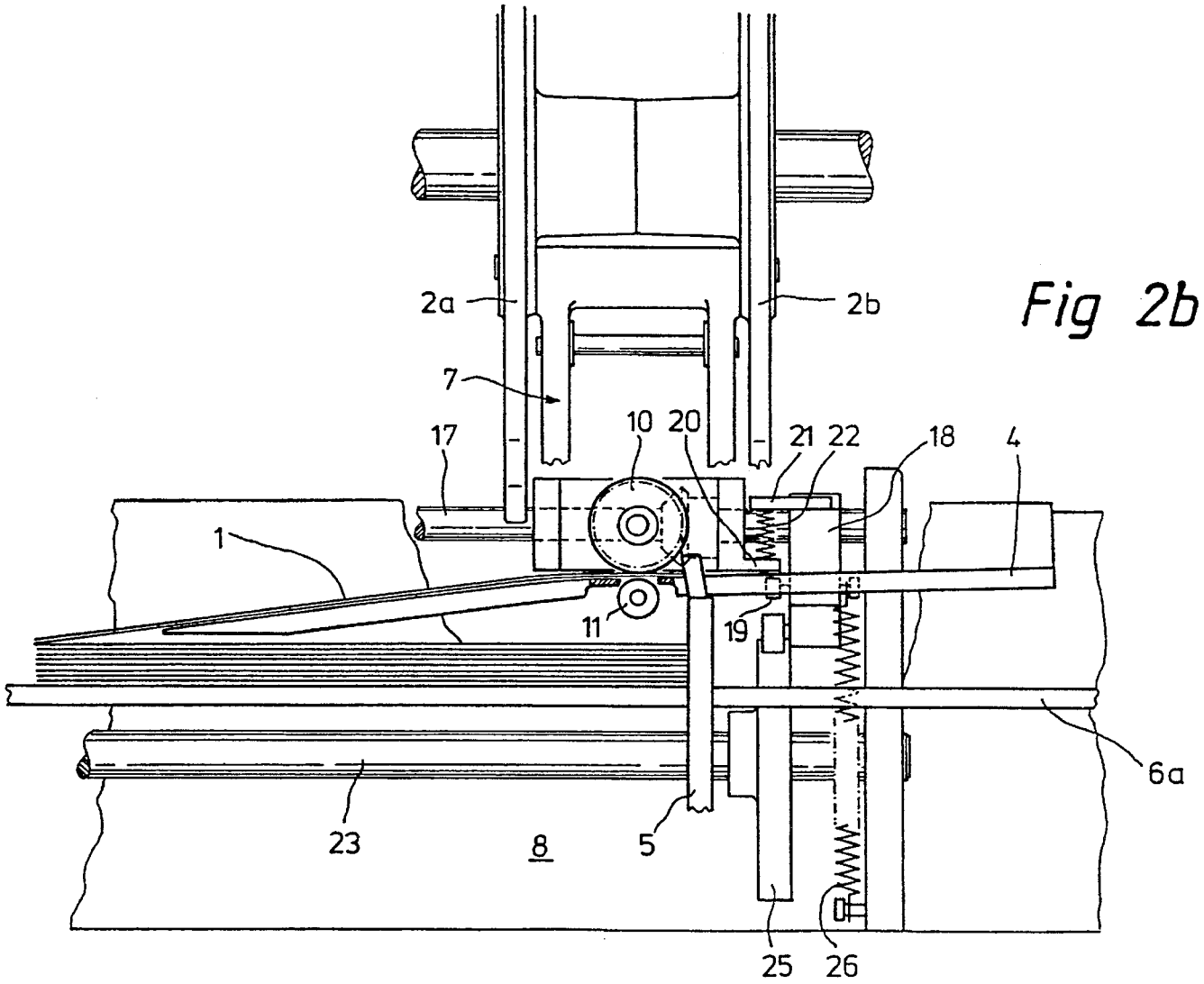
FIG. 2*b* is a view similar to FIG. 2*a* showing the pre-accelerated sheet in engagement with the conveyor pusher element.

Printed sheets withdrawn from the feed magazine are deposited on table 4, i.e., are released by the gripper mechanism 7, so as to be in abutting relationship with a lateral guide 9. The gathering conveyor 6 includes moving pusher elements 5, only one of which is shown, which extend through both a longitudinal aperture 6*b* in the bottom 6*a* of the gathering channel defined by conveyor 6 and a longitudinal aperture 4*a* in receiving table 4. The moving pusher elements 5 acquire a printed sheet 1 deposited on receiving table 4 and, while moving in the downstream direction, sweep the printed sheet from the receiving table into the channel of the gathering conveyor 6, the channel being disposed beneath the receiving table 4 and in part being defined by bottom 6*a*. FIG. 2*a* shows the condition where a pusher element 5 has not caught up with a sheet 1 on receiving table 4 while FIG. 2*b* shows the pusher element 5 as it is about to initiate the pushing of the sheet 1 down a ramp located at the downstream end of receiving table 4 and into registration with a stack of sheets which have already been formed in the gathering conveyor through the action of upstream feeder stations. A hold-down device will act on the leading edge portion of a printed sheet which is moving in the conveying direction on receiving table 4 in order to ensure that the movement of the sheet being fed into the channel of the gathering conveyor follows the path defined by the surface of table 4.

As may be clearly seen from FIGS. 1 and 2, the receiving table 4 and the bottom 6*a* of the gathering conveyor 6 are fixed to, and extend from, a side frame 8 of the collating machine. The manner in which the table 4 and channel defining member 6*a* are mounted defines the proper vertical separation between table 4 and the support surface of the gathering conveyor.

In accordance with the present invention, each feeder station includes means for pre-accelerating the printed sheets 1 subsequent to their deposition on the receiving table 4 and prior to their acquisition by a pusher element 5. The pre-accelerating means comprises an accelerating roller 10 (see FIG. 2) which is continuously rotated by drive means to be described below. The accelerating roller 10 is located between the planes defined by the pull-off drum side plates 2*a* and 2*b*, i.e., in registration with the transfer zone defined by the rotating gripper mechanism 7. The accelerating roller 10 is also located adjacent to the lateral guide 9. In order to acquire a printed sheet 1 deposited on receiving table 4, and in the maner to be described below, accelerating roller 10 will be moved toward and away from a supporting roller 11 in synchronism with the motion of the pusher elements 5. The pre-accelerating means also includes the above-mentioned supporting roller 11. Roller 11 has an axis of rotation located beneath the upper surface of receiving table 4. In the disclosed embodiment, supporting roller 11 is an idler roll. The diameter of roller 11 is selected so that its peripheral surface projects slightly above the level of receiving table 4. Accordingly, a functional association will be established between accelerating roller 10 and idler roller 11. Roller 11 will preferably be resiliently mounted so as to be capable of swinging in pendulum fashion for adapting to the position of the accelerating roller.

Figure 3:
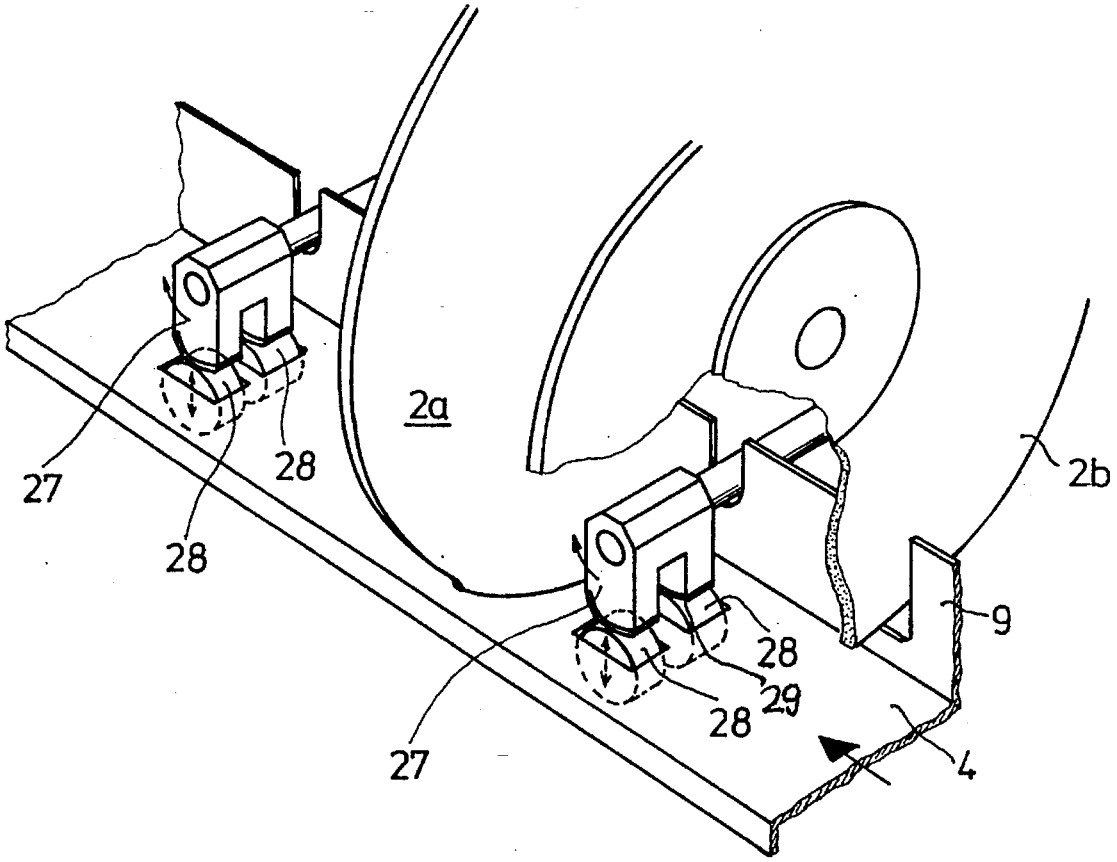
FIG. 3 is a partial perspective view, partly in section, which represents apparatus in accordance with an alternative embodiment of the invention.

In the embodiment of FIGS. 1 and 2, in the interest of eliminating the possibility of the printed sheets 1 being torn as a result of the pre-acceleration, such tearing having particularly been a problem in the prior art in the case of printed sheets of broadside or landscape format, the accelerating roller 10 is actually defined by a pair of spaced roller elements 10*a* and 10*b*. The roller elements 10*a* and 10*b* are mounted so as to ensure conformance with the swing-angle of the accelerating roller assembly 10. As represented in FIG. 3, a second pair of cooperating accelerating roller or roller segments can be positioned at a defined distance downstream of the rollers 10 and 11 in the acceleration direction.

Accelerating roller 10 is fixed to a drive shaft 14, i.e., relative rotation between roller 10 and shaft 14 cannot occur. Drive shaft 14 extends through lateral guide 9 and side frame 8 and is continuously rotated, through bevel gears 15, by drive means which has not been shown in the drawings in the interest of facilitating understanding of the invention. Drive shaft 14 and bevel gears 15 are mounted in a generally U-shaped housing 16. Housing 16 is mounted for pivotal motion about the axis of a driven shaft 17 which is also supported in the collating machine frame. Shaft 17 rotatably supports a plate 18. Plate 18, in turn, carries a stop 19 which cooperates with a tongue 20 extending from housing 16. A compression spring 22 extends between tongue 20 and a projection 21 on plate 18. Accordingly, plate 18 is coupled to housing 16 via a resilient connecting link, i.e., the spring 22. Compression spring 22, acting through housing 16 and drive shaft 14, biases accelerating roller 10 into contact with a printed sheet 1 supported on the idler roller 11. The resilient coupling established by spring 22 provides compensation for different thicknesses in the printed sheets being collated.

The above-mentioned pivotal motion of accelerating roller 10 in synchronism with the movement of the pusher elements 5 is implemented through the agency of a disc-like drive cam 25. Cam 25 is rotated by drive means, not shown, acting on a drive shaft 23. Cam 25 is contacted by a cam follower 24 mounted on plate 18. The cam follower 24 is held in contact with cam 25 by means of a spring 26 which extends between plate 18 and the machine frame.

The accelerating roller 10 is provided with a facing layer comprised of a resilient, non-slip material. While not shown in FIGS. 1 and 2, this layer of non-slip material is indicated at 29 on FIG. 3. The provision of the layer 29 ensures that the printed sheet 1 is driven without slip.

The above-mentioned hold-down device, which acts on the leading edge portion of a printed sheet 1 to hold the sheet on the receiving table 4 during the pre-acceleration, will be located downstream of the pull-off drum 2 in the acceleration direction. The hold-down device may, for example, be in the form of a suitably shaped spring finger 30 or the like as shown in FIG. 2*a*.

As illustrated in FIG. 2*b*, it is advantageous in the practice of the present invention for the accelerating roller 10 to maintain functional association with the printed sheet 1 until the leading edge of the printed sheet comes in contact with the previously gathered stack of sheets which are traveling along the conveyor under the influence of the pusher element 5.

Referring to FIG. 3, which illustrates a modified form of the invention, the accelerating roller or rollers may be in the form of a plurality of roller segments 27, having arcuate contacting surfaces, located on a common shaft and separated by a defined interval. In such case, each segment 27 will cooperate with a separate idler roller 28 which extends upwardly through the receiving table 4. As will be obvious to those of ordinary skill, the plural accelerating rollers and/or plural idler rollers of the FIG. 3 embodiment may be incorporated into the embodiment of FIGS. 1 and 2. Also, as noted above, the second or downstream accelerating roller arrangement of FIG. 3 may be employed in the embodiment of FIGS. 1 and 2.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a sheet feeder station for a collating apparatus, the collating apparatus including a conveyor having at least a first moving pusher element, the conveyor defining a transport channel which extends through the feeder station, the pusher element cooperating with the transport channel to define a transport direction for sheets deposited in the transport channel, the feeder station including a receiving table and gripper means for engaging and subsequently extracting individual sheets from a stack of sheets and depositing such engaged sheets on the receiving table, the sheets subsequently being contacted by the at least first pusher element of the conveyor and being swept thereby from the receiving table into the conveyor defined transport channel and subsequently moved along the channel, the gripper means engaging a sheet within a region of predetermined length which extends in a first direction which is generally parallel to the direction of sheet movement along the conveyor defined transport channel, the gripper means moving in a transfer zone which extends in a second direction which is generally transverse to the first direction during the transfer of an engaged sheet from a stack to the receiving table, the improvement comprising:

means for imparting movement to sheets deposited on the receiving table prior to contact thereof by the first pusher element of the conveyor, said movement imparting means including:

rotatable accelerating means having a sheet contacting portion within the transfer zone for imparting movement to sheets contacted thereby, said accelerating means being positioned to contact a first side of a sheet supported on the receiving table; and support roller means for cooperating with said accelerating means, said support roller means contacting a sheet to be accelerated on the second opposite side thereof in registration with said accelerating means, the sheet being captured between said accelerating means and said support roller means and being caused to move along the receiving table in the transport direction, whereby the sheet is transferred directly from the gripper means into contact with said imparting means.

2. The apparatus of claim 1 further comprising:

second rotatable accelerating means for imparting movement to sheets contacted thereby, said second accelerating means being positioned to contact a first side of a sheet supported on the receiving table in a region located downstream, in the direction of sheet movement on the table, from the transfer zone; and second support roller means for cooperating with said second accelerating means, said second support roller means contacting a sheet to be accelerated on the said second side thereof in registration with said second accelerating means.

3. The apparatus of claim 1 wherein said support roller means comprises at least a first roller mounted such that the peripheral surface thereof projects slightly above the sheet supporting surface of the receiving table.

4. The apparatus of claim 1 further comprising:

means for resiliently biasing said accelerating means in the direction of said support roller means.

5. The apparatus of claim 1 wherein said rotatable accelerating means comprises:

at least a first accelerating roller, said accelerating roller being provided with a facing layer comprising a resilient, non-slip material.

6. The apparatus of claim 1 wherein said rotatable accelerating means comprises:

a pair of segments, each of said segments having an arcuate sheet contacting surface portion, said segments being located on a common shaft and being separated by a defined interval; and wherein said support roller means comprises:

a pair of support rollers, said support rollers respectively cooperating with one of said segments.

7. The apparatus of claim 1 wherein said accelerating means is positioned relative to the receiving table such that contact is maintained between said accelerating means and a sheet being accelerated until the sheet has been moved a distance in the transport direction sufficient to cause the leading edge of the sheet to be located in the conveyor defined channel in contact with a stack of sheets already formed in the channel.

8. The apparatus of claim 1 further comprising:

means for holding a sheet contacted by said accelerating means against the receiving table, said holding means acting on the sheet at a point downstream, in the direction of sheet travel on the receiving table, from said accelerating means.

9. The apparatus of claim 1 wherein said support roller means comprises at least a pair of resiliently mounted rollers, said resiliently mounted rollers being separated by a defined interval.

10. The apparatus of claim 1 wherein the gripper means is a pull-off drum having a pair of oppositely disposed side plates, said side plates defining generally parallel planes which intersect the receiving table, and wherein said accelerating means is positioned between said side plate defined planes.

11. The apparatus of claim 10 wherein said accelerating means comprises:

at least a first driven roller; and means mounting said driven roller for pivotal motion toward and away from said support roller means.

12. The apparatus of claim 11 wherein said driven roller has at least a pair of spaced sheet contacting members mounted on a common shaft.

13. The apparatus of claim 12 wherein said accelerating means is positioned relative to the receiving table such that contact is maintained between said accelerating means and a sheet being accelerated until the sheet has been moved a distance in the transport direction sufficient to cause the leading edge of the sheet to be located in the conveyor defined channel in contact with a stack of sheets already formed in the channel.

14. The apparatus of claim 11 further comprising:

second rotatable accelerating means for imparting movement to sheets contacted thereby, said second accelerating means being positioned to contact a first side of a sheet supported on the receiving table in a region located downstream, in the direction of sheet movement on the table, from the transfer zone; and second support roller means for cooperating with said second accelerating means, said second support roller means contacting a sheet to be accelerated on the said second side thereof in registration with said second accelerating means.

15. The apparatus of claim 11 wherein said support roller means comprises at least a first roller mounted such that the peripheral surface thereof projects slightly above the sheet supporting surface of the receiving table.

16. The apparatus of claim 15 further comprising:

means for resiliently biasing said accelerating means in the direction of said support roller means.

17. The apparatus of claim 16 wherein said support roller means roller is resiliently mounted so as to be self-adjusting in response to contact with said accelerating means driven roller.

18. The apparatus of claim 1 wherein said accelerating means comprises:

at least a first driven roller; and means mounting said driven roller for pivotal motion toward and away from said support roller means.

19. The apparatus of claim 18 wherein said driven roller has at least a pair of spaced sheet contacting members mounted on a common shaft.

20. The apparatus of claim 18 wherein said support roller means comprises at least a first resiliently supported roller, said resiliently supported roller being self-adjusting in response to contact with said accelerating means driven roller.

* * * * *